US010680326B2

(12) United States Patent
Georgakopoulos

(10) Patent No.: US 10,680,326 B2
(45) Date of Patent: Jun. 9, 2020

(54) ROBOTIC INTELLIGENT ANTENNAS

(71) Applicant: Stavros Georgakopoulos, Boca Raton, FL (US)

(72) Inventor: Stavros Georgakopoulos, Boca Raton, FL (US)

(73) Assignee: The Florida International University Board of Trustees, Miami, FL (US)

( * ) Notice: Subject to any disclaimer, the term of this patent is extended or adjusted under 35 U.S.C. 154(b) by 189 days.

(21) Appl. No.: 16/026,607

(22) Filed: Jul. 3, 2018

(65) Prior Publication Data

US 2020/0014104 A1 Jan. 9, 2020

(51) Int. Cl.
*H01Q 3/01* (2006.01)
*H01Q 21/06* (2006.01)
*H01Q 1/08* (2006.01)

(52) U.S. Cl.
CPC ..... *H01Q 3/01* (2013.01); *H01Q 1/081* (2013.01); *H01Q 21/065* (2013.01)

(58) Field of Classification Search
CPC ..... H01Q 1/081; H01Q 1/08; H01Q 21/06; H01Q 21/065; H01Q 3/01
See application file for complete search history.

(56) References Cited

U.S. PATENT DOCUMENTS

| | | | | |
|---|---|---|---|---|
| 6,628,240 | B2 * | 9/2003 | Amadeo | G06K 19/07718 235/492 |
| 8,952,863 | B2 * | 2/2015 | Hague | H01Q 1/38 343/880 |
| 9,236,653 | B2 * | 1/2016 | Liu | H01Q 1/38 |
| 9,263,803 | B1 * | 2/2016 | Weller | H01Q 19/005 |
| 10,128,572 | B2 * | 11/2018 | Caratelli | H01Q 9/0407 |
| 10,379,217 | B2 * | 8/2019 | Wang | H01Q 5/22 |

* cited by examiner

*Primary Examiner* — Tho G Phan
(74) *Attorney, Agent, or Firm* — Saliwanchik, Lloyd & Eisenschenk

(57) ABSTRACT

A device for an intelligent robotic antenna is provided. The intelligent robot antenna can comprise a substrate made from a compliant material, a conductive antenna element disposed on the substrate, a sensor that sense environmental conditions around the antenna, an actuator that transforms the antenna, and artificial intelligence software that can determine an optimal structural geometry of the antenna based upon the environmental characteristics surrounding the antenna, and direct the actuator to transform the structural geometry of the antenna to an optimal structural geometry.

20 Claims, 18 Drawing Sheets

700

710

ROBOTIC INTELLIGENT ANTENNAS

BACKGROUND

Reconfigurable antennas, which can be compressed, expanded, deflated, or inflated, can be useful for satellite communications, military applications, and hostile environments. In such applications, it is important for the antenna to be responsive to environmental and signal changes. Antenna capability can be enhanced through the use of artificial intelligence to continuously monitor the surrounding environment and real time signal requirements to dynamically transform an antenna structure in response to external or internal stimuli.

BRIEF SUMMARY

Embodiments of the subject invention provide robotic intelligent antennas, and methods of fabricating and using the same, that can change their geometry and function by using robotic mechanisms and artificial intelligence (AI) to optimize or reconfigure performance. Robotic mechanisms can guide different components of the antenna in order to change the structural geometry of the antenna.

Soft robotics technology can be used to fabricate the intelligent antennas. Soft robotic actuators can be used to transform the geometry of the antenna. The transformation of robotic antenna can be guided by artificial intelligence (AI) in order to create intelligent and robotic communication systems that dynamically optimize or change performance (e.g., change frequency of operation, pattern, gain, bandwidth, polarization, or achieve intelligent beamforming) by adapting to changes in demand and/or the environment. AI can be implemented in the RF systems and/or digital signal processing systems connected to the antenna in order to make the antenna intelligent Embodiments of the subject invention also include intelligent and robotic energy harvesting systems that dynamically change their performance and adapt to changes in demand and/or the environment.

BRIEF DESCRIPTION OF THE DRAWINGS

FIG. 6(*b*) is a diagram illustrating the flat copper trace antenna transformed to a conical spiral shape antenna.

FIG. 7(*b*) is the array of flat spiral antennas after a transformation to conical structure antennas.

FIG. 8(*b*) is a diagram of flat reflector transformed to a parabolic reflector.

FIG. 11(*b*) is a diagram illustrating a transformation of a planar reflector with a helix antenna to a parabolic reflector with a helix antenna. FIG. 11(*c*) is a diagram illustrating a transformation of a planar reflector with a helix antenna to a parabolic reflector with a helix antenna.

18*a* is a diagram of a first state of a robotic expandable/collapsible cylinder antenna.

DETAILED DESCRIPTION

Embodiments of the subject invention provide robotic intelligent antennas, and methods of fabricating and using the same, that can change geometry and function using robotics and artificial intelligence (AI) to optimize or reconfigure performance. Robotic mechanisms can guide different components of the antenna in order to change the structural geometry of the antenna.

As used herein, the term "antenna" refers generally to any electromagnetic structure, such as and antenna, antenna array, energy harvester, and frequency selective surface.

The antennas can be integrated with actuation mechanisms, scaffolding, RF connectors, and an artificial intelligence device. The conductive antenna elements can include but are not limited to conductive cloth tape, conductive thread, conductive tape, conductive wire, conductive sheet, conductive pipes, and liquid metals. The conductive antenna elements can also be made using insulated wire, coaxial cable, and/or speedometer wire.

Figure 1:
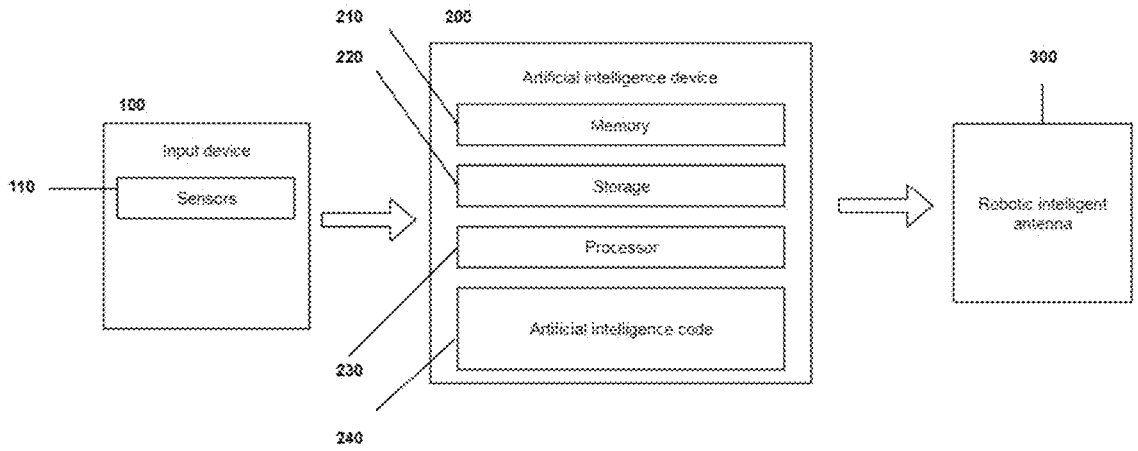
FIG. 1 is a block diagram of a robotic intelligent antenna system.

FIG. 1 is a block diagram of a robotic intelligent antenna coupled with an artificial intelligence system. An input device 100 can be configured to receive or capture, via a sensor 110, or a peripheral device (not pictured), environmental data, real time transmission characteristics, or robotic antenna information. The input device 100 can receive data directly from a user or the sensors 110. The input device 100 can communicate with an artificial intelligence device 200 through a communication network. The artificial intelligence device 200 can be a component of an RF system or a digital signal processing system connected to the robotic intelligent antenna 300 (both not pictured). A communication network may be, for example, a communications port, a wired transceiver, a wireless transceiver, and/or a network card. The communication network may be capable of communicating using technologies such as Ethernet, fiber optics, microwave, xDSL (Digital Subscriber Line), Wireless Local Area Network (WLAN) technology, wireless cellular technology, bluetooth technology, and/or any other appropriate technology.

The input device 100 can directly or wirelessly transmit received inputs to the artificial intelligence device 200 comprising working memory and non-volatile program memory 210, storage 220, a processor 230, and deep learning code 240. The memory device 210 may be or include a device such as a Dynamic Random Access Memory (D-RAM), Static RAM (S-RAM), or other RAM or a flash memory. The artificial intelligence code 240 can be embedded within the artificial intelligence device 200 or provided by an external source. The internal or external storage 220 may be or include a hard disk, a magneto-optical medium, an optical medium such as a CD-ROM, a digital versatile disk (DVDs), or BLU-RAY disc (BD), or other type of device for electronic data storage. The artificial intelligence device 200 can process the received data and direct a robotic intelligent antenna 300 to be transformed to an optimal configuration. The robotic intelligent antenna 300 can be in electronic communication with the artificial intelligence device 200 directly through a communication network.

Although FIG. 1 shows that the artificial intelligence device 200 comprises a single memory device 210, a single processor 230, a single input device 100, and a single robotic intelligent antenna 300, the system can include multiples of each or any combination of these components, and may be configured to perform analogous functionality to that described herein.

In some embodiments the input device 100, the artificial intelligence device 200, and the robotic intelligent antenna 300 are a single device. In other embodiments, the input device 100, the artificial intelligence device 200, and the robotic intelligent antenna 300 can be remotely situated and connected via a communication network.

Figure 2:
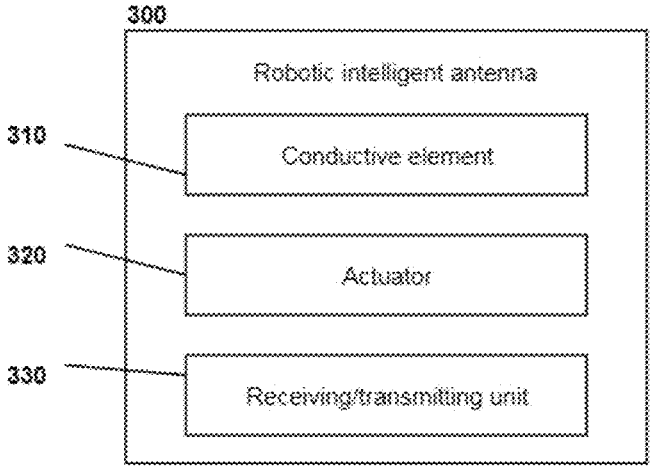
FIG. 2 is a block diagram of a robotic intelligent antenna.

As seen in FIG. 2, the robotic intelligent antenna 300 can comprise a conductive antenna element 310 including an array of conductive antenna elements 310. The conductive antenna elements can be electrically connected to each other and to a receiving/transmitting unit 330. A switching device can be used to permit only a section or certain sections of the array of conductive antenna elements 310 to transmit or receive a signal. The conductive antenna elements 310 can be situated on a flat surface of a substrate material or fitted into grooves in the substrate to more securely fasten the conductive antenna elements to the substrate.

An actuator 320 can be used in order to change the structural geometry of the intelligent robotic antenna. The actuator 320 can comprise a pump for inflating or deflating the antenna structure. In other embodiments the actuator 320 comprises a motor capable of extending or retracting components of the antenna 300 in the x, y, and z directions.

The intelligent robotic antenna 300 can be fabricated using soft robotic technology. An antenna 300 can comprise an array of elements made from conductive materials disposed on a substrate made from highly compliant material. In other embodiments, the soft robotic antenna comprises separate components configured to provide mechanical flexibility. For example, the soft robotic antenna 300 can comprise an array of conductive antenna elements on multiple rigid components connected via hinges, textiles, or other components providing mechanical flexibility. The conductive materials can include copper, precious metals including gold or silver, or any other suitable conductive material. The array of conductive antenna elements can electrically connected by a conductive wire.

The intelligent robotic antenna can also be configured to transform through a reaction with an electrical impulse. For example electroactive polymers can be employed that transform in the presence of an electric field.

As biomimicry is a design principle behind soft robotics, in other embodiments the robotic intelligent antenna comprises materials or a structural design that transform due to changes in the ambient environment and without any external input from an electronic device. For example, the antenna can be configured to transform in response to changes in wind pressure, exposure to temperature changes, exposure or absence of sunlight, or exposure to liquids or moisture.

In certain embodiments, the intelligent robotic antenna can be used in a multiple-input multiple-output (MIMO) system. In certain embodiments, multiple intelligent robotic antennas can be used at the transmitter and receiver ends of a MIMO system. In other embodiments, the intelligent robotic antenna can be configured to transmit and receive multiple data signals or data packets. Signals or data packets can be transmitted or received through various techniques, such as MIMO Eigen-beamforming, space-time coding, and spatial multiplexing.

The intelligent robotic antenna can be used for multifunctional communications, tactical antennas, deployable and reconfigurable antennas, space borne antenna, and airborne antennas. As seen in FIGS. 3 through 15 the intelligent robotic antenna can be configured to different structural geometries in order to be suitable for specific applications.

In certain embodiments of the subject invention, artificial intelligence algorithms can be employed to accept as inputs, environmental, electrical, and signal characteristics to optimize the structure of the robotic antenna to effectuate intelligent beamforming. This intelligent beamforming can be utilized through beamforming algorithms to control power and optimize signal transfer.

Figure 3:
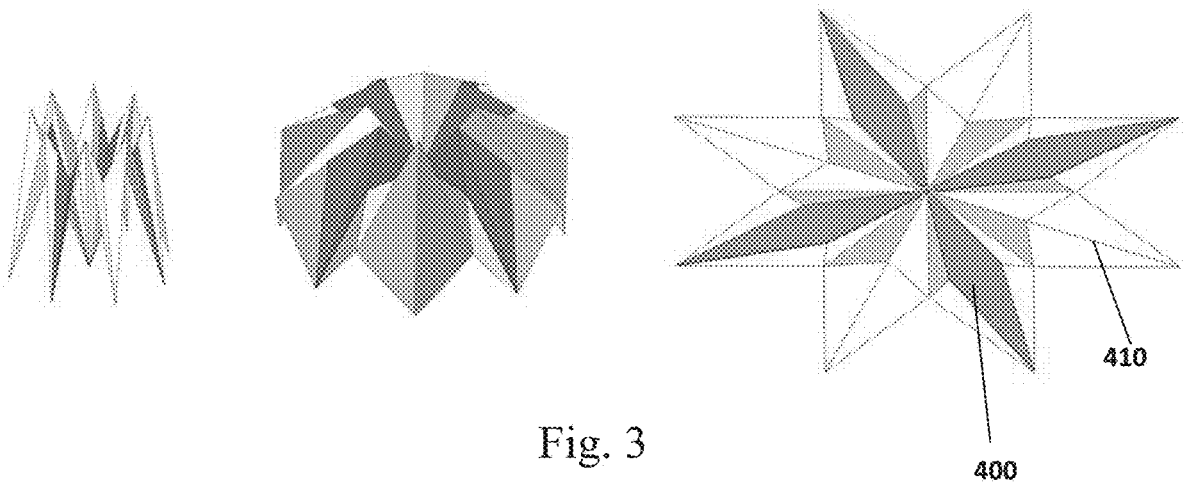
FIG. 3 is a diagram illustrating a transformation of a robotic intelligent antenna.

As seen in FIG. 3, the intelligent robotic antenna can assume a compressed form and in response to an input from a user or as a reaction to an environmental change, the antenna can unfold into a flat planar star like structure comprised of a substrate 410 and four conductive antenna elements 400 configured to extend outward from a center.

Figure 4:
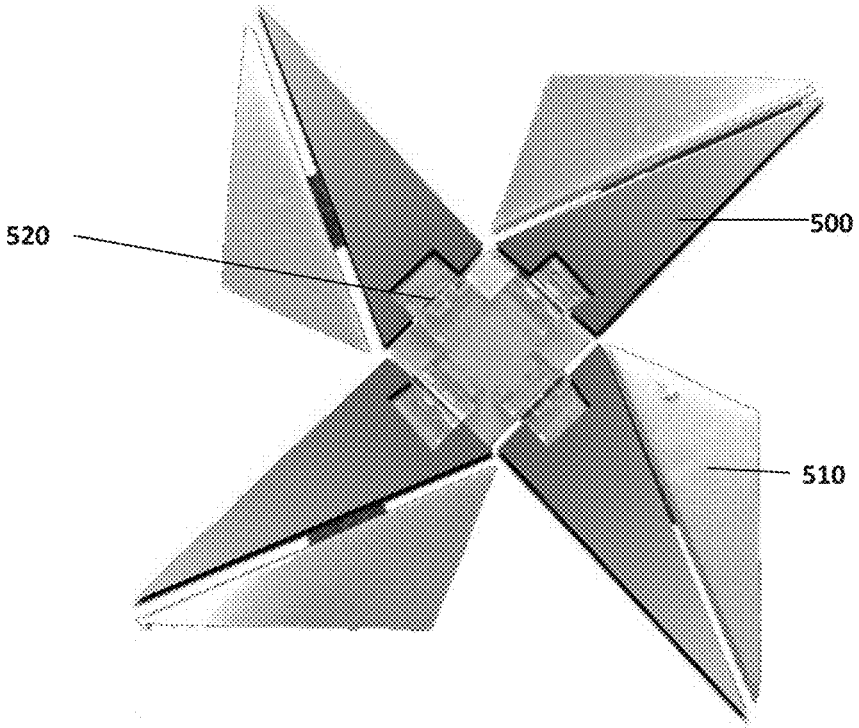
FIG. 4 is a diagram of a robotic intelligent antenna.

In another embodiment, as seen in FIG. 4, the antenna comprises a flat rectangular substrate 510 connected by hinges 520 to four conductive antenna elements 500. Each respective conductive antenna element can have a triangular shape and be connected to a respective triangular shaped substrate 510 to form a diamond shaped pattern. When in a flat planar configuration the four conductive antenna elements 500 can be arranged to form a cross dipole antenna.

Figure 5:
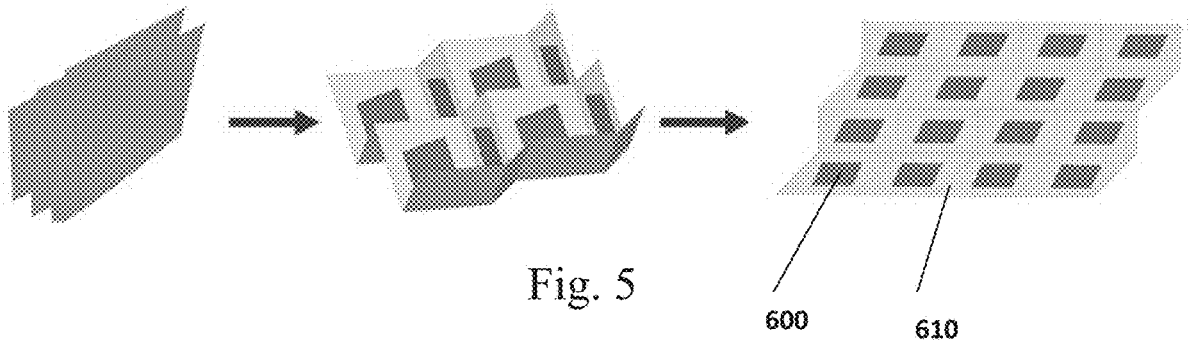
FIG. 5 is a diagram of a robotic intelligent antenna transforming into a flat planar patch array antenna.

As seen in FIG. 5, the antenna can comprise an array of conductive antenna elements 600 arranged in a grid configuration and on a substrate 610. The substrate 610 can be made from a highly compliant material such that the antenna can be folded to prevent the array from being exposed to the environment.

Figure 6A:
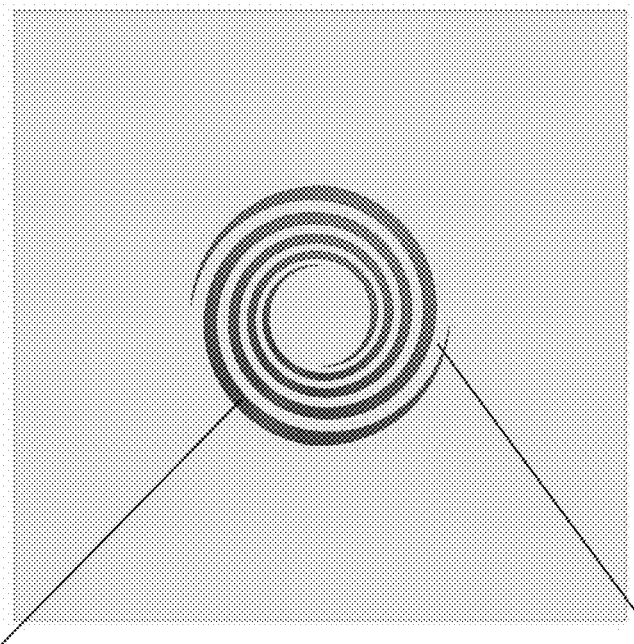
FIG. 6(*a*) is a diagram of a planar copper trace on a substrate.
Figure 6B:
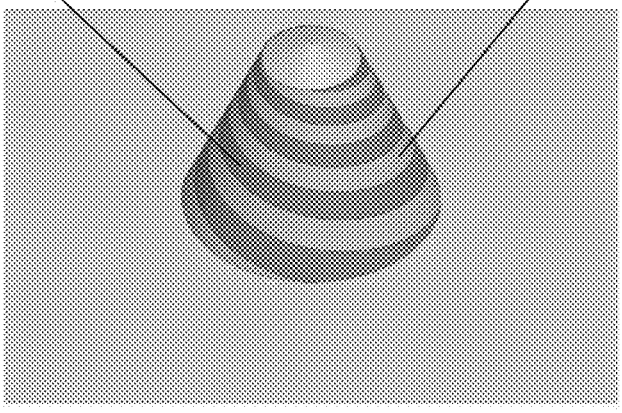
Figure 7A:
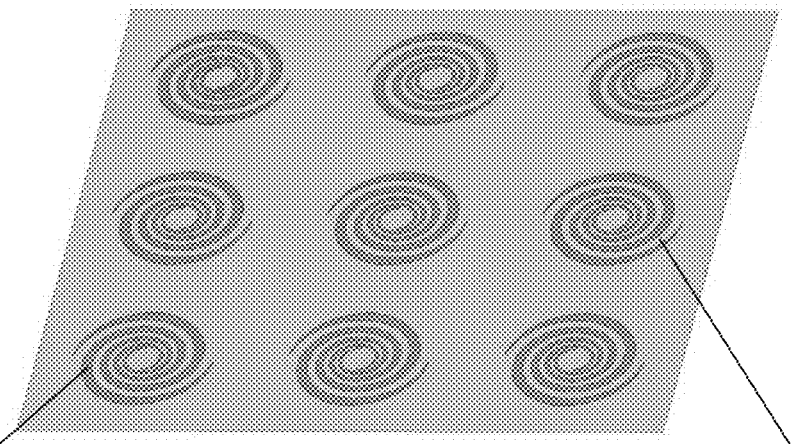
FIG. 7(*a*) is a diagram of a planar array of spiral antennas.
Figure 7B:
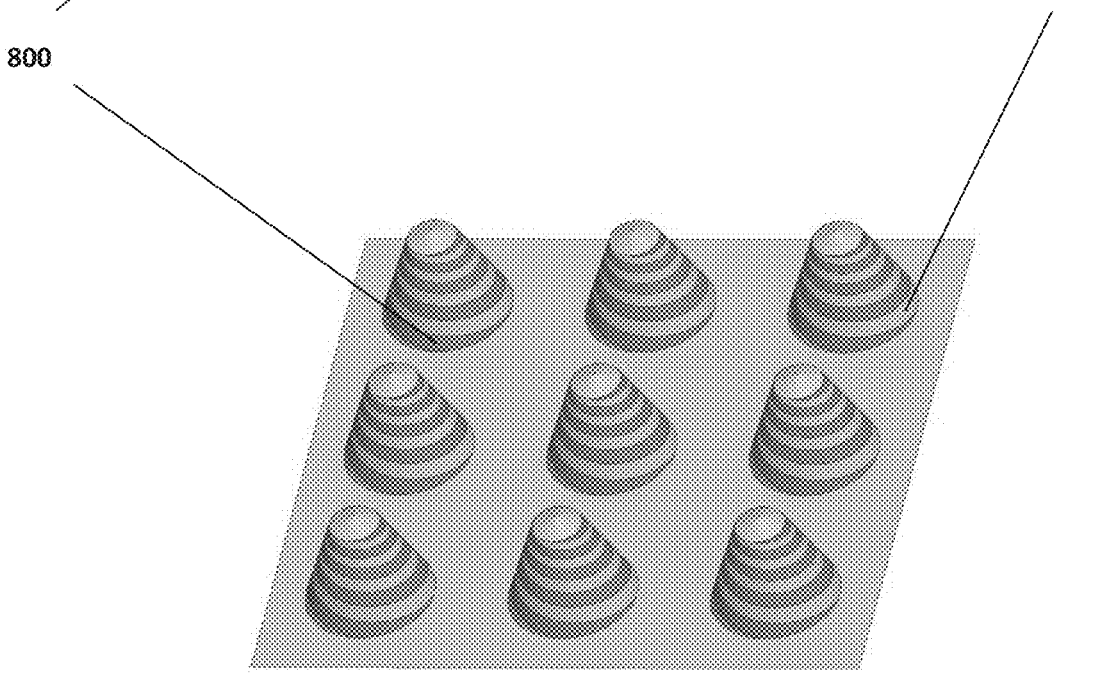
Figure 8A:
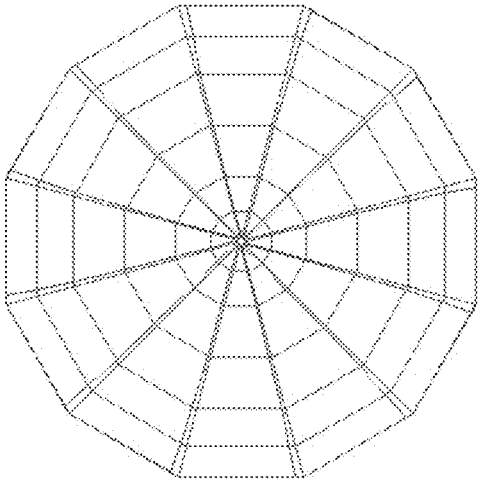
FIG. 8(*a*) is a planar view of a flat reflector.
Figure 8B:
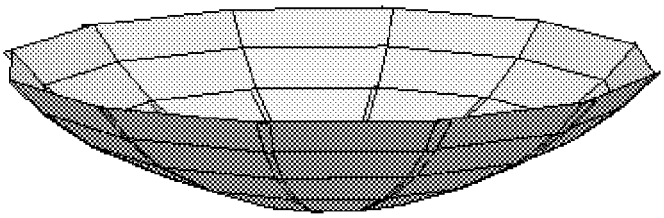

In order to maximize broadband characteristics, the antenna can be configured to be a conical antenna, as seen in FIGS. 6(*a*) and 6(*b*). The conductive antenna element 700 can be a single element or multiple elements arranged in a spiral configuration on a substrate 710. The antenna can be configured to transform from a flat planar structure (see, for example, FIG. 6(*a*)) to protrude outward from the substrate 710 to form a conical antenna (see, for example, FIG. 6(*b*)). As seen in FIG. 7, in another embodiment the conductive antenna element comprises multiple conductive antenna elements, each in a respective conical form and arranged in a grid configuration.

Figure 9:
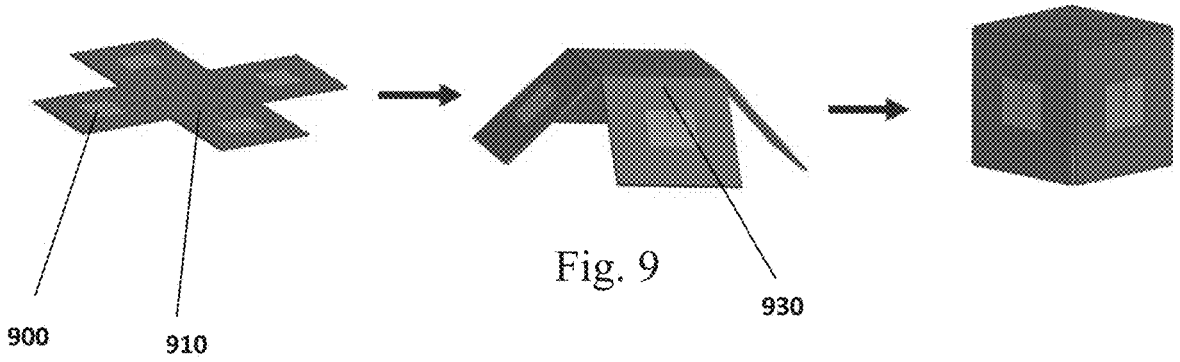
FIG. 9 is a diagram illustrating a transformation of a planar patch array antenna to a three dimensional patch array antenna.

As seen in FIG. 9, in another embodiment, the antenna can transform from a flat planar configuration into a three dimensional cube like configuration. In the flat planar configuration the antenna can comprise a substrate 910 having a Greek cross shape, in which each bar has an equal length. A respective conductive antenna element 900 can be disposed on each protruding portion of the substrate 910 and be connected to each other conductive antenna element 900 by a wire or conductive trace 930. Each protruding portion of the substrate 910 can fold in an orthogonal direction from the center portion to form a cube like structure of the antenna.

Figure 10:
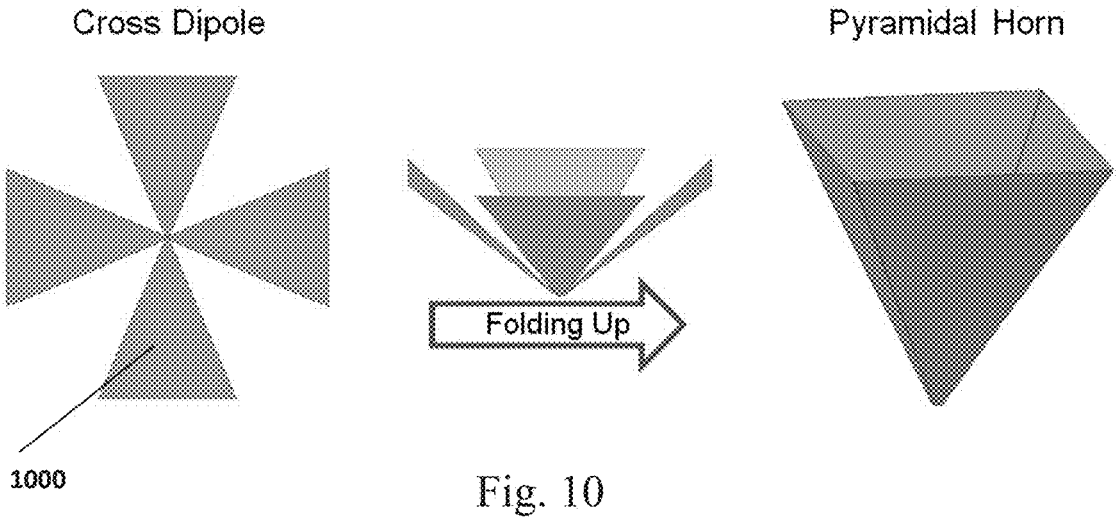
FIG. 10 is a diagram illustrating a transformation of a cross dipole antenna to a pyramidal horn antenna.

The antenna can also be a cross dipole or a turnstile antenna in a flat planar configuration, as seen in FIG. 10. The antenna can comprise a plurality of triangular shaped conductive antenna elements 1000 each connected to the other at a triangular tip of the each respective conductive antenna element 1000. In order to transform, each conductive antenna element 1000 can fold inward until each conductive antenna element 1000 is connected to each adjacent pair of conductive antenna elements. The resulting structure is a pyramidal horn antenna in which the conductive antenna elements 1000 come together to form a waveguide.

Figure 11A:
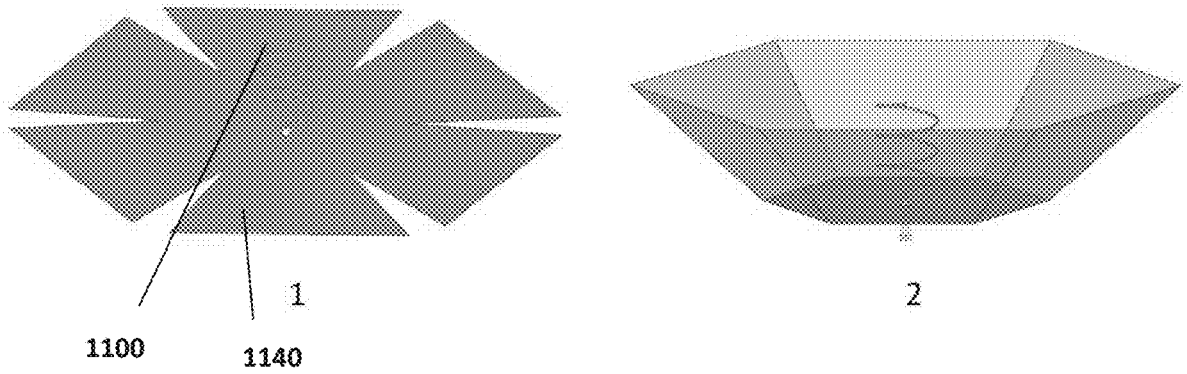
FIG. 11(*a*) is a diagram illustrating a transformation of a planar reflector with a helix antenna to a parabolic reflector with a helix antenna.
Figure 11B:
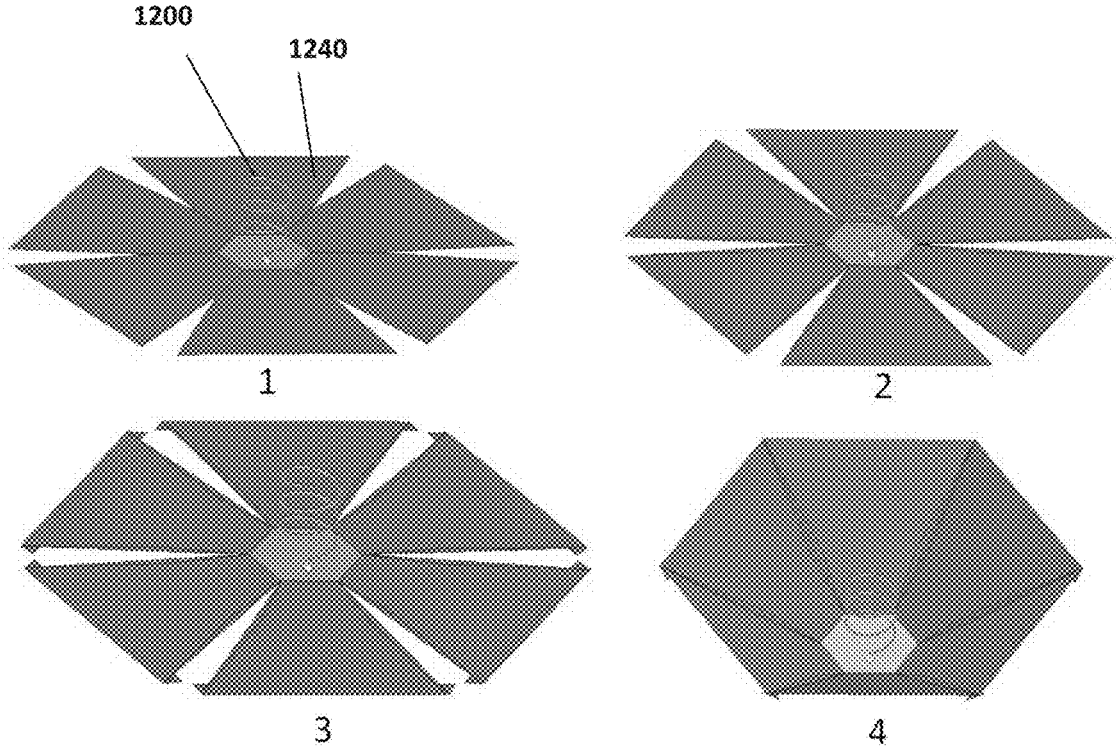
Figure 11C:
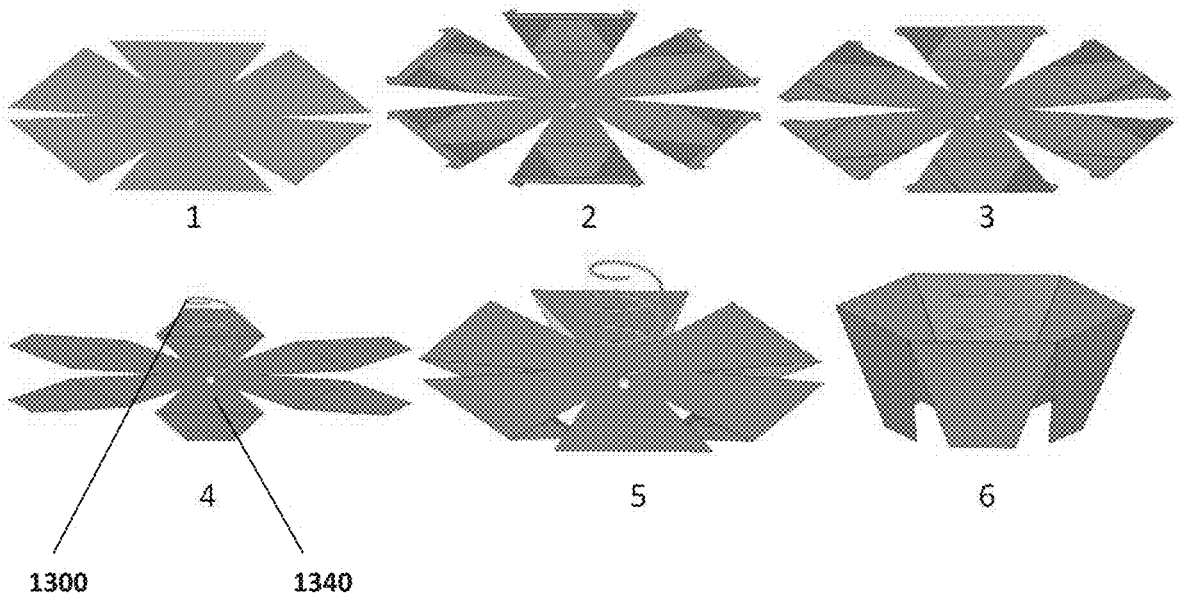

In other embodiments, the substrate can comprise a reflective material. The reflective material can form the surface of parabolic dish or mirror in order to collect or reflect electromagnetic waves. Furthermore, the conductive antenna element can be in the form of a helical or helix antenna, which can for example provide circularly polarized waves. This configuration can be used in satellite assisted communications systems. FIGS. 11(*a*)-11(*b*) show three embodiments of a flat planar reflective substrate with a helix antenna transforming into a parabolic reflector based antenna.

As seen in FIG. 11(*a*) a flat planar configuration comprises a reflective material 1140 in a multi-bar cross shape and having a helical antenna 1100 extending in an orthogonal direction from a center of the cross. Each bar can have a trapezoidal shape and be connected to a center portion. The antenna can be transformed by raising the bars in the direction of the helical antenna 1140 until the two sides of each bar are in contact with an edge of each respective adjacent bar. In another embodiment, as seen in FIG. 11(*b*), a portion of the reflective material 1240 including an outer edge of each bar can be configured to fold over in direction opposite of the direction of the helical antenna 1200.

FIG. 11(*c*) shows another embodiment of a parabolic reflector with a helical antenna. Each bar of a multi-bar cross planar configuration can have a trapezoidal shape and be connected at a trapezoidal base to a center portion of the reflective material 1340. A portion of the reflective material 1340 including an outer tip of each respective trapezoidal shaped portion can be configured to fold such that each resulting bar is in the form of two trapezoids connected at a base and extending in opposite directions. Each respective inner trapezoid can be raised in a direction of the helical antenna 1300 to form a parabolic reflector dish. Each respective outer trapezoid can bend in an opposite direction of the helical antenna 1300. The antenna can be further configured such that each respective outer base edge of each outer trapezoid is either higher than, coplanar with, or lower than the center portion of the antenna.

Figure 12:
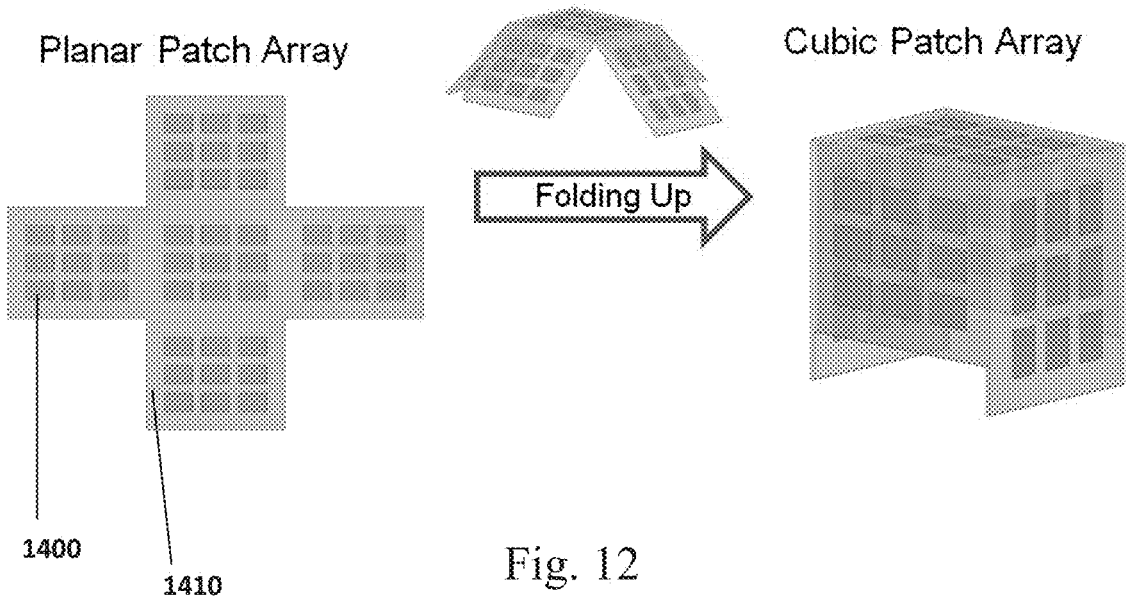
FIG. 12 is a diagram illustrating a transformation of a planar patch array antenna into a cubic patch array antenna.

FIG. 12 shows another embodiment of the subject invention. The antenna can transform from a flat planar configuration into a three dimensional configuration. In the flat planar configuration, the antenna comprises a cross shaped antenna substrate 1410 having a center portion and each respective side of the center portion being attached to a respective rectangular shaped portion protruding from the center portion of the substrate 1410. A respective array of conductive antenna elements 1400 can be disposed on each protruding porting of the substrate 1410. Each protruding portion of the substrate 1410 can fold in an orthogonal direction from the center portion to form a cubic patch array antenna. The conductive antenna elements of each array 1400 can be disposed on the substrate to extend in a linear or perpendicular direction from a second array of conductive antenna elements 1400.

Figure 13:
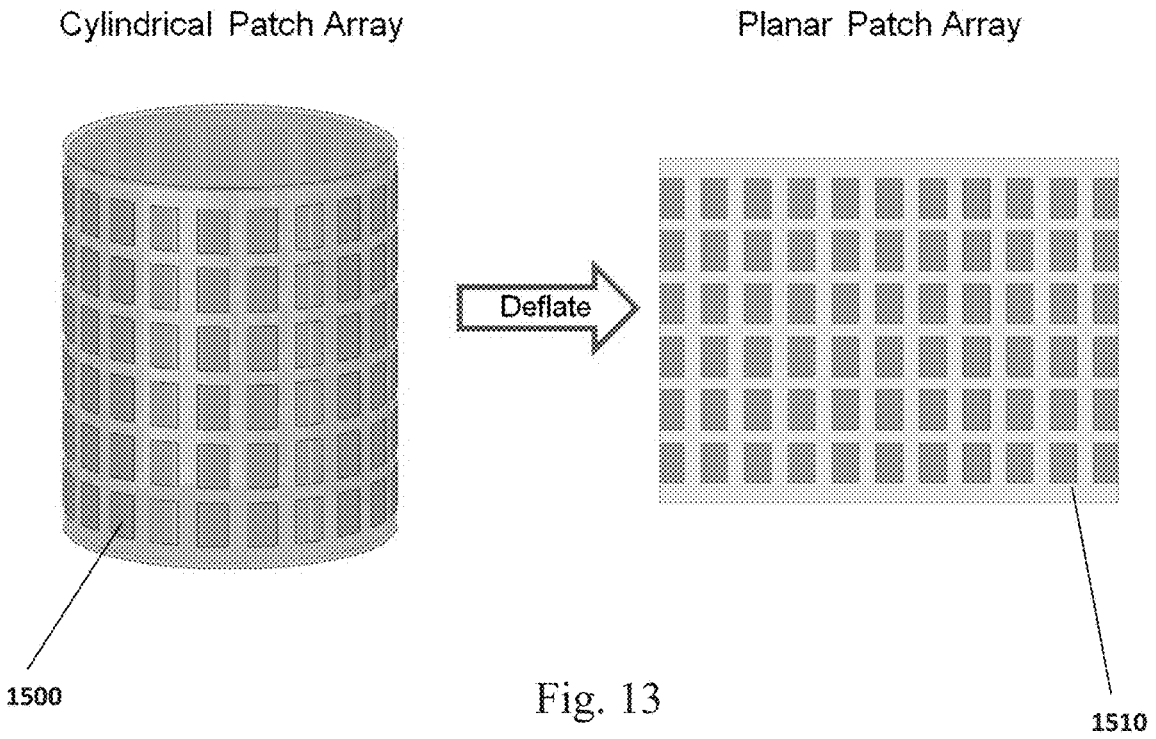
FIG. 13 is a diagram illustrating a transformation of a cylindrical patch array antenna into a planar patch array antenna.

FIG. 13 shows an antenna having an array of conductive antenna elements 1500 on an outer surface of a cylindrical substrate 1510. The cylindrical substrate 1510 can comprise a compliant material that permits the antenna to be deflated to transform into a planar patch array antenna. Each opposite surface of the planar patch array antenna has an array of conductive antenna elements 1500.

Figure 14:
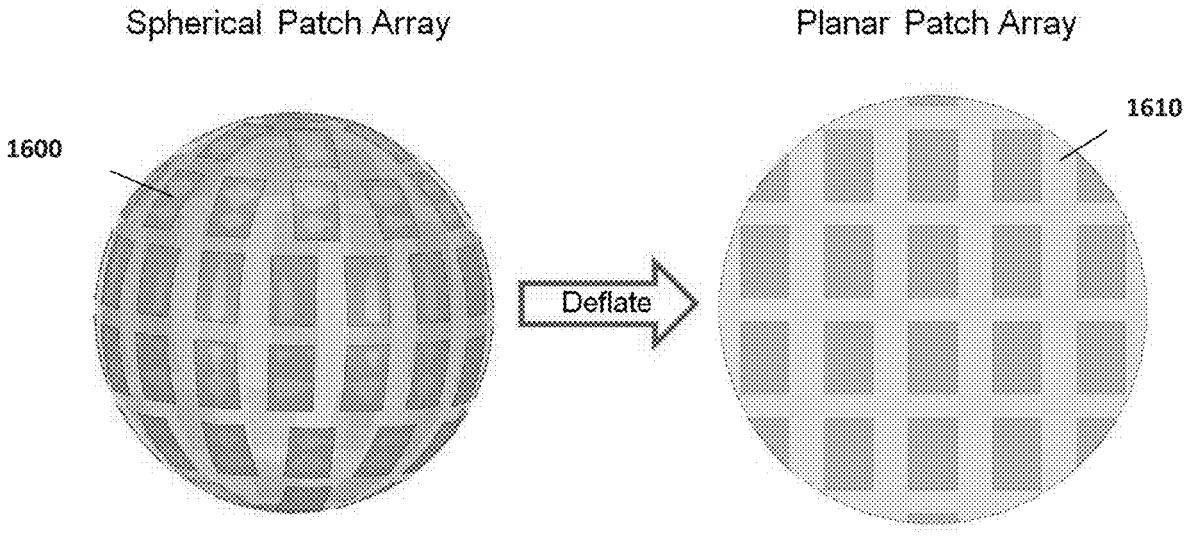
FIG. 14 is a diagram illustrating a transformation of a spherical patch array antenna into a planar patch array antenna.

FIG. 14 shows a spherical patch array antenna that can transform into a planar patch array antenna. An array of conductive antenna elements 1600 on an outer surface of a spherical substrate 1610. The spherical substrate 1610 can comprise a compliant material that permits the antenna to be deflated to transform into a planar patch array antenna. Each opposite surface of the planar patch array antenna has an array of conductive antenna elements 1600.

Figure 15:
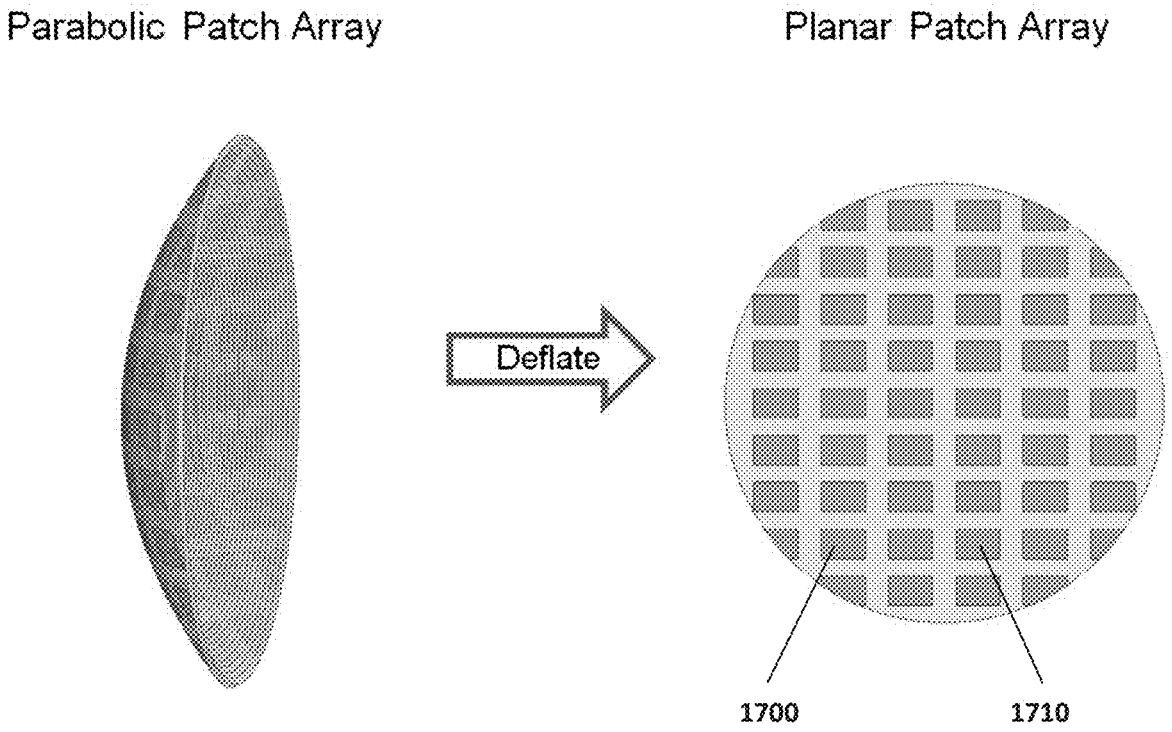
FIG. 15 is a diagram illustrating a transformation of a parabolic patch array antenna into a planar patch array antenna.

FIG. 15 shows a parabolic patch array antenna that can transform into a planar patch array antenna. An array of conductive antenna elements 1700 can be disposed on an outer surface of a parabolic substrate 1710. The parabolic substrate 1710 can comprise a compliant material that permits the antenna to be deflated to transform into a planar patch array antenna.

Robotic intelligent antennas can also include liquid metal antennas comprising configurable substrates combined with microfluidic channels that allow liquid metal to flow through the substrates. The liquid metal can comprise gallium or a gallium alloy. The liquid metal can be stored in a reservoir connected to the microfluidic channels and be controlled a pump or a micro-pump.

Figure 16A:
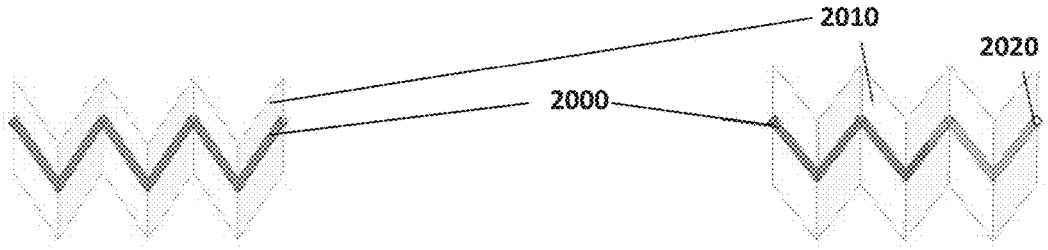
FIG. 16*a* is a diagram of a first state of a robotic accordion antenna.
Figure 16B:
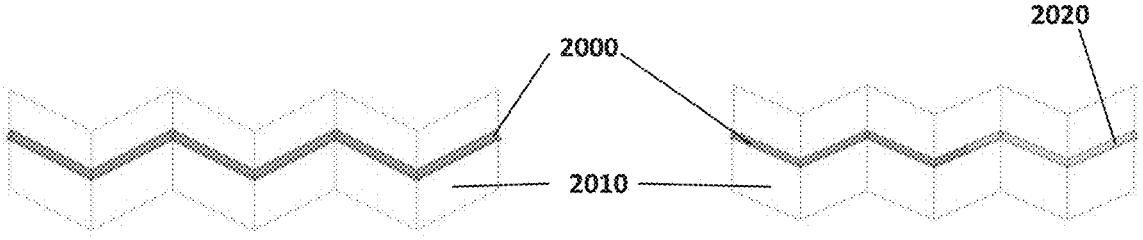
FIG. 16*b* is a diagram of a second state of a robotic accordion antenna.
Figure 16C:
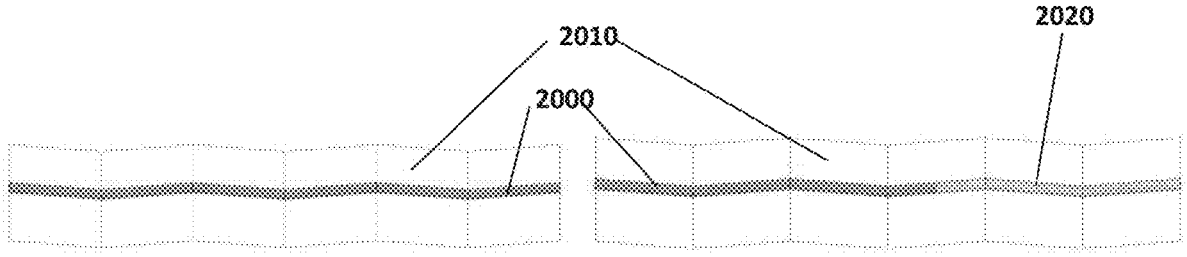
FIG. 16*c* is a diagram of a third state of a robotic accordion antenna.

FIG. 16*a* shows a diagram of a first state of a robotic accordion antenna. FIG. 16*b* is a diagram of a second state of a robotic accordion antenna. FIG. 16*c* is a diagram of a third state of a robotic accordion antenna. The reconfigurable substrate 2010 can be in a folded state with a microfluidic channel 2020. The liquid metal 2000 can flow through the microfluidic channel 2020 or be stored in a liquid metal reservoir (not shown) connected to the microfluidic channel 2020. By increasing or decreasing the amount of liquid metal 2000 in the microfluidic channel 2010, the antenna characteristics can be modified or optimized, including the frequency and radiation pattern.

The microfluidic channel can contain liquid metal, and the antenna characteristics (e.g., electrical performance) can be altered based upon the shape/geometry of the conducting trace that forms the antenna. The liquid metal can be directed (e.g., using pumps and/or micro-pumps) to flow and fill certain portions of the microfluidic channel or channels as the robotic antenna changes its shape, which in turn changes the shape/geometry of the conductive trace of the antenna and therefore changes the electrical performance of the antenna.

The liquid metal can flow through complex microfluidic channels that are controlled by switched gates in order to form complex antenna traces and transform the antenna trace from one shape to another. Additionally, liquid metals can be used on hinges to provide electrical continuity between solid conductors that connect to the hinges.

Figure 17A:
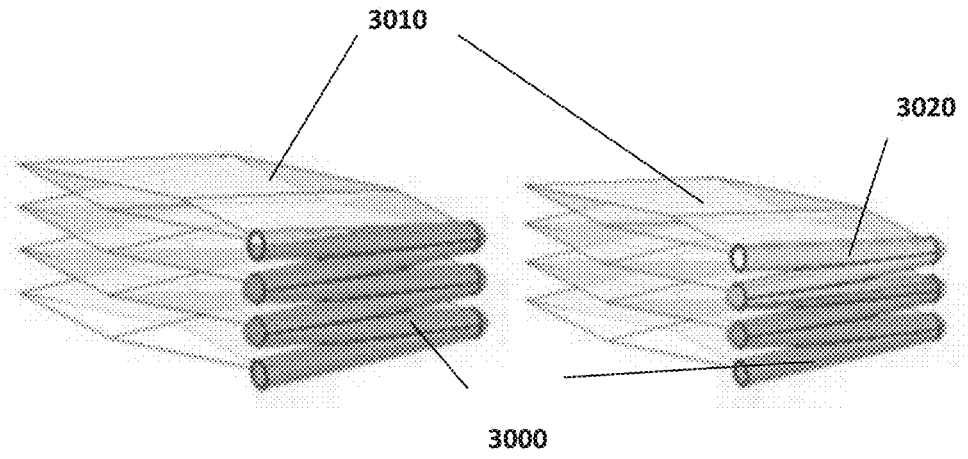
FIG. 17*a* is a diagram of a first state of a robotic folding tube antenna.
Figure 17B:
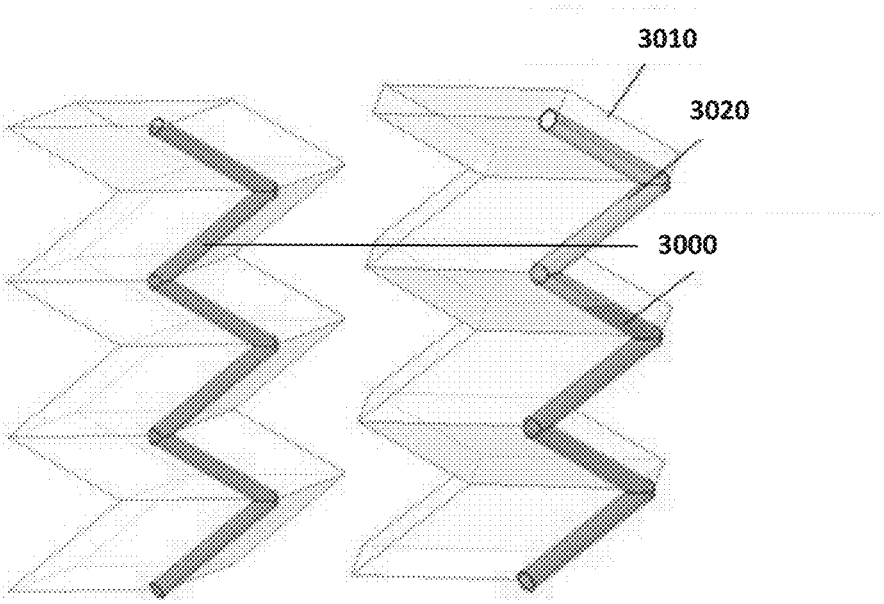
FIG. 17*b* is a diagram of a second state of a robotic folding tube antenna.
Figure 17C:
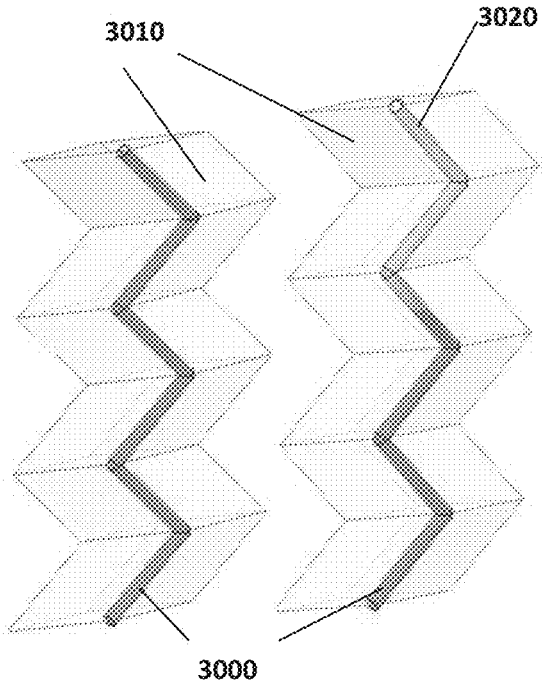
FIG. 17*c* is a diagram of a third state of a robotic folding tube antenna.

FIG. 17*a* is a diagram of a first state of a robotic folding tube antenna. FIG. 17*b* is a diagram of a second state of a robotic folding tube antenna. FIG. 17*c* is a diagram of a third state of a robotic folding tube antenna. The substrate 3010 has a tubular structure and the microfluidic channel 3020 can be disposed on the inside, the outside, or within the reconfigurable substrate 3010. The liquid metal 3000 can either flow through the microfluidic channel 3020 or be stored in a liquid metal reservoir (not shown) connected to the microfluidic channel.

Figure 18A:
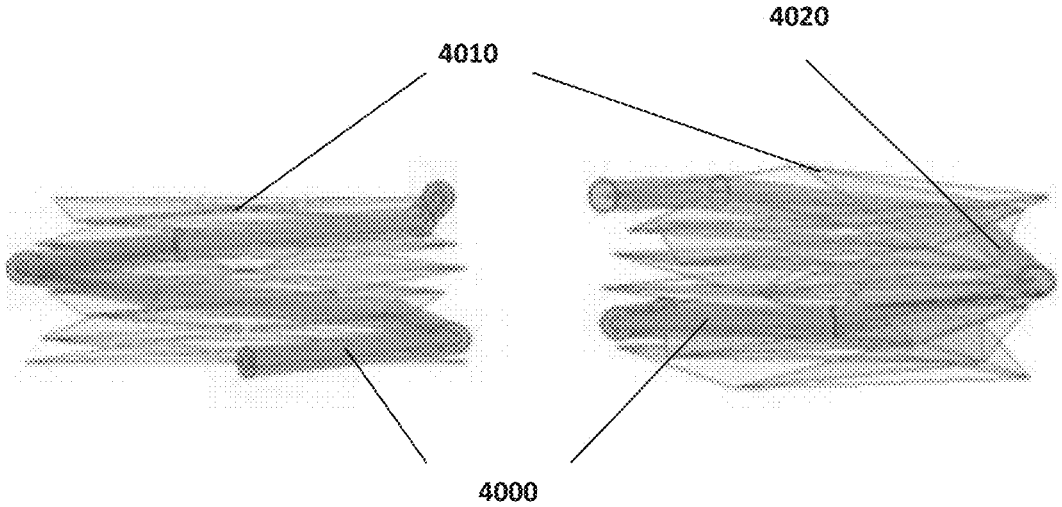
FIG. 18*b* is a diagram of a second state of a robotic expandable/collapsible cylinder antenna.
FIG. 18*c* is a diagram of a third state of a robotic expandable/collapsible cylinder antenna.
Figure 18B:
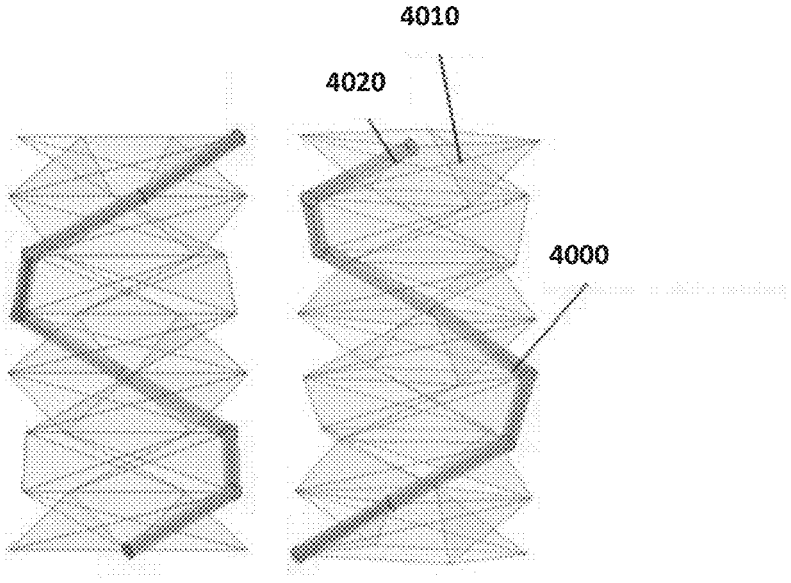
Figure 18C:
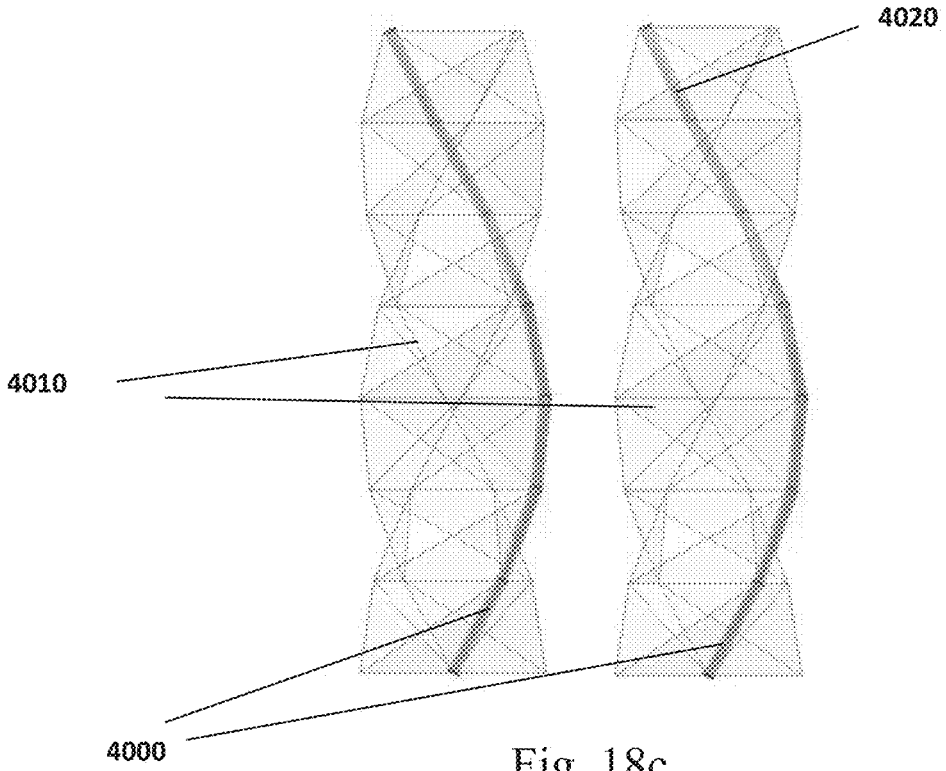

FIG. 18*a* is a diagram of a first state of a robotic expandable/collapsible cylinder antenna. FIG. 18*b* is a diagram of a second state of a robotic expandable/collapsible cylinder antenna. FIG. 18*c* is a diagram of a third state of a robotic expandable/collapsible cylinder antenna. The substrate 4010 has a cylindrical structure and the microfluidic channel 4020 can be spiraled on the inside, outside, or within the cylinder. The liquid metal 4000 can either flow through the microfluidic channel 4020 or be stored in a liquid metal reservoir (not shown) connected to the microfluidic channel.

Figure 19A:
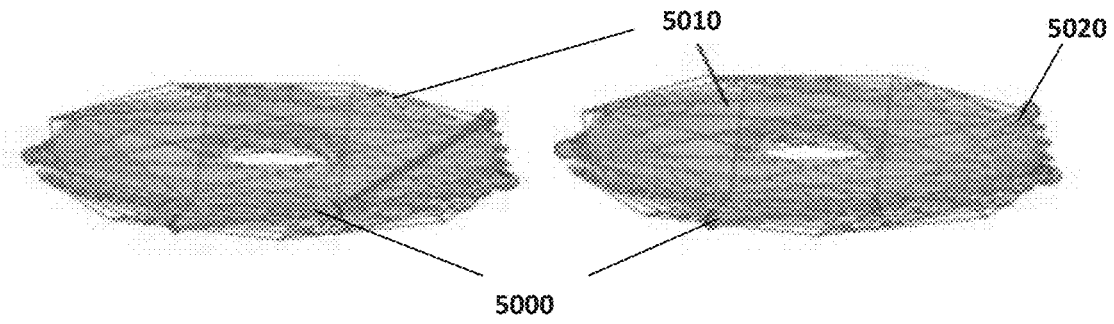
FIG. 19*a* is a diagram of a first state of a robotic inflatable cylinder antenna.
Figure 19B:
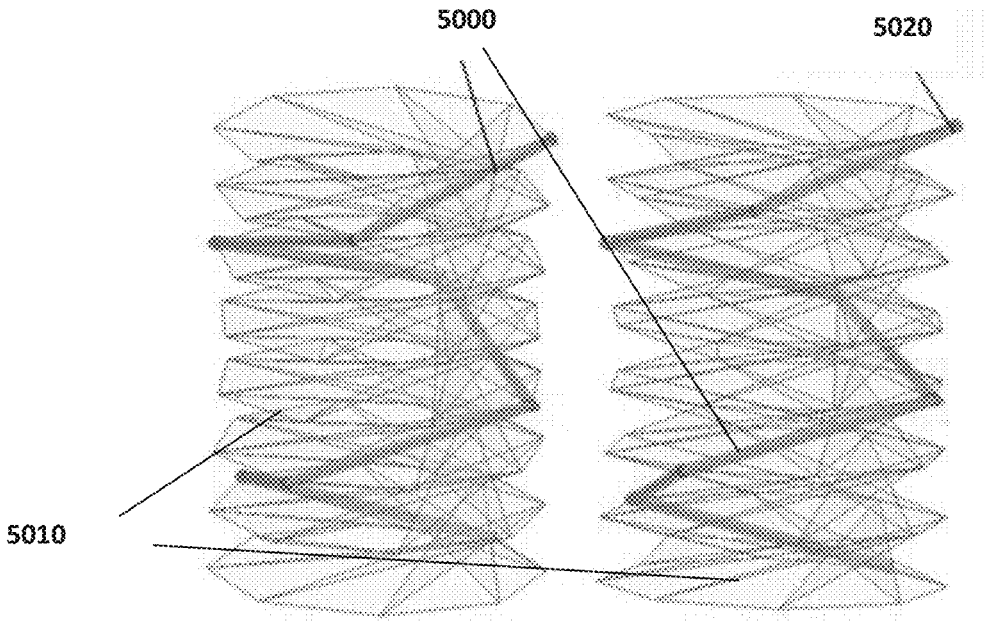
FIG. 19*b* is a diagram of a second state of a robotic inflatable cylinder antenna.
Figure 19C:
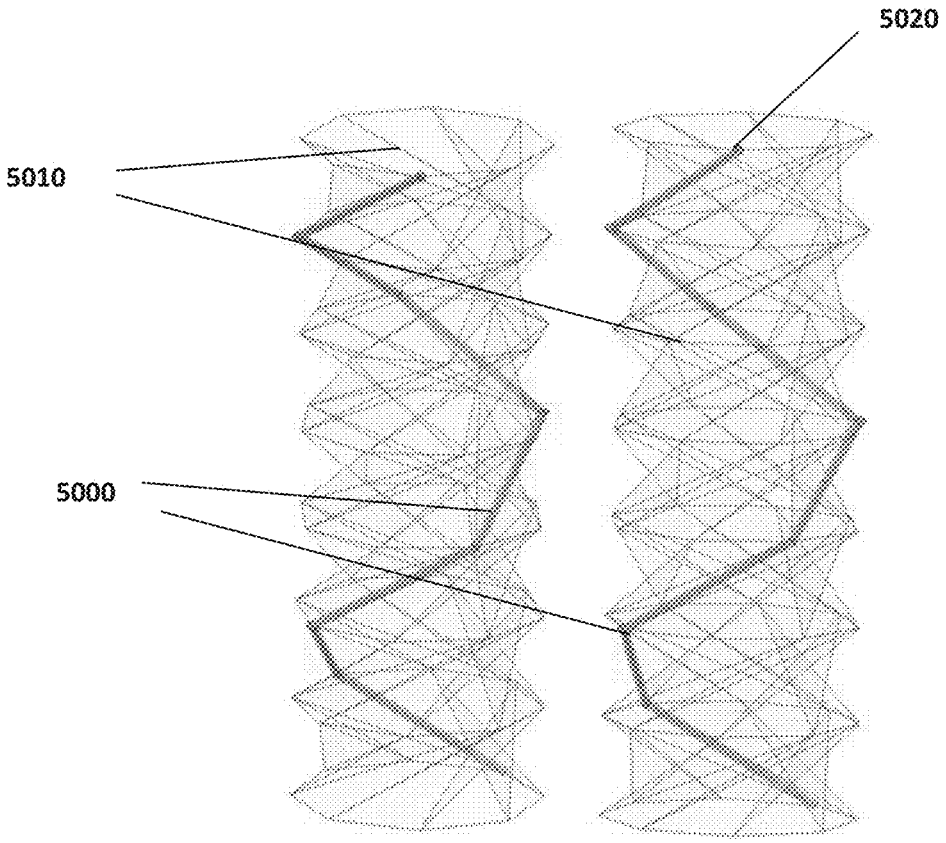
FIG. 19*c* is a diagram of a third state of a robotic inflatable cylinder antenna.

FIG. 19*a* is a diagram of a first state of a robotic inflatable cylinder antenna. FIG. 19*b* is a diagram of a second state of a robotic inflatable cylinder antenna. FIG. 19*c* is a diagram of a third state of a robotic inflatable cylinder antenna. The substrate 5010 has a cylindrical structure and the microfluidic channel 5020 can be spiraled on the inside, outside, or within the cylinder. The liquid metal 5000 can either flow through the microfluidic channel 5020 or be stored in a liquid metal reservoir (not shown) connected to the microfluidic channel.

In certain embodiments of the subject invention, the reconfigurable substrate comprises multiple microfluidic channels.

The methods and processes described herein can be embodied as code and/or data. The software code and data described herein can be stored on one or more machine-readable media (e.g., computer-readable media), which may include any device or medium that can store code and/or data for use by a computer system. When a computer system and/or processer reads and executes the code and/or data stored on a computer-readable medium, the computer system and/or processer performs the methods and processes embodied as data structures and code stored within the computer-readable storage medium. It should be appreciated by those skilled in the art that computer-readable media include removable and non-removable structures/devices that can be used for storage of information, such as computer-readable instructions, data structures, program modules, and other data used by a computing system/environment. A computer-readable medium includes, but is not limited to, volatile memory such as random access memories (RAM, DRAM, SRAM); and non-volatile memory such as flash memory, various read-only-memories (ROM, PROM, EPROM, EEPROM), magnetic and ferromagnetic/ferroelectric memories (MRAM, FeRAM), and magnetic and optical storage devices (hard drives, magnetic tape, CDs, DVDs); network devices; or other media now known or later developed that are capable of storing computer-readable information/data. Computer-readable media should not be construed or interpreted to include any propagating signals. A computer-readable medium of the subject invention can be, for example, a compact disc (CD), digital video disc (DVD), flash memory device, volatile memory, or a hard disk drive (HDD), such as an external HDD or the HDD of a computing device, though embodiments are not limited thereto. A computing device can be, for example, a laptop computer, desktop computer, server, cell phone, or tablet, though embodiments are not limited thereto.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein (including those in the "References" section) are incorporated by reference in their entirety, including all figures and tables, to the extent they are not inconsistent with the explicit teachings of this specification.

What is claimed is:

1. An intelligent robotic antenna, comprising:
- a substrate comprising a compliant material;
- a conductive antenna element disposed on the substrate;
- a sensor;
- an actuator connected to the substrate; and
- a non-transitory computer readable medium comprising stored instructions that when executed cause at least one processor to:
  - sense, by the sensor, environmental characteristics surrounding the antenna;
  - execute artificial intelligence code to determine an optimal structural geometry of the antenna based upon the environmental characteristics surrounding the antenna; and
  - transform, by the actuator, a structural geometry of the antenna to the optimal structural geometry of the antenna.

2. The intelligent robotic antenna according to claim 1, the environmental characteristics comprising at least one of wind pressure, exposure to temperature changes, exposure or absence of sunlight, and exposure to liquids or moisture.

3. The intelligent robotic antenna according to claim 1, the sensor being configured to sense characteristics of transmission and receiving signals of the antenna and the artificial intelligence code being configured to determine an optimal structural geometry of the antenna based upon desired characteristics of the transmission and the receiving signals of the antenna.

4. The intelligent robotic antenna according to claim 1, the actuator being a motor configured to move the substrate in the x-, y-, and z-directions.

5. The intelligent robotic antenna according to claim 1, the actuator being a pump configured to inflate or deflate the substrate.

6. The intelligent robotic antenna according to claim 1, the conductive antenna element comprising an array of conductive antenna elements arranged in a grid formation and in electrical connection on the substrate.

7. The intelligent robotic antenna according to claim 1, the conductive antenna element comprising a plurality of conductive antenna elements arranged in a spiral formation and in electrical connection on the substrate; and
- the substrate being configured to protrude outwardly to form a conical structure.

8. The intelligent robotic antenna according to claim 1, the substrate comprising a Greek cross structure;

the conductive antenna element comprising a plurality of conductive antenna elements and disposed at a center of each protruding portion of each respective bar of the Greek cross structure; and each respective bar of the Greek cross structure being configured to bend towards a single direction to form a five-sided three dimensional structure.

9. The intelligent robotic antenna according to claim 1, the substrate comprising a cross structure having two bars, one bar of the cross structure having a length greater than the other bar; the conductive antenna element comprising an array of conductive antenna elements connected electrically and disposed on each on each respective bar of the cross structure; and each respective bar of the cross structure being configured to bend towards a single direction to form a five-sided three dimensional like structure.

10. The intelligent robotic antenna according to claim 1, the substrate comprising a cylindrical structure;

the conductive antenna element comprising an array of conductive antenna elements disposed on an outer surface of the cylindrical structure; and the substrate being configured to deflate to form a flat planar structure having an array of conductive antenna elements on each respective side of the flat planar structure.

11. The intelligent robotic antenna according to claim 1, the substrate comprising a spherical structure;

the conductive antenna element comprising an array of conductive antenna elements disposed on an outer surface of the spherical structure; and the substrate being configured to deflate to form a flat circular structure having an array of conductive antenna elements on each respective side of the flat circular structure.

12. The intelligent robotic antenna according to claim 1, the substrate comprising a parabolic structure;

the conductive antenna element comprising an array of conductive antenna elements disposed on an outer surface of the parabolic structure; and the substrate being configured to deflate to form a flat circular structure having an array of conductive antenna elements on one side of the flat circular structure.

13. An intelligent robotic antenna, comprising:

a substrate comprising a reflective material;

a conductive antenna element disposed on the substrate;

a sensor;

an actuator connected to the substrate; and a non-transitory computer readable medium comprising stored instructions that when executed cause at least one processor to:

sense, by the sensor, environmental characteristics surrounding the antenna;

execute artificial intelligence code to determine an optimal structural geometry of the antenna based upon the environmental characteristics surrounding the antenna; and transform, by the actuator, a structural geometry of the antenna to the optimal structural geometry of the antenna.

14. The intelligent robotic antenna according to claim 13, the substrate comprising a six-sided cross structure;

each protruding portion of the six-sided cross structure having trapezoid shape;

the conductive antenna element having a helical shape protruding in a normal direction from a plane of a center portion of the six-sided cross structure; and each protruding portion of the six sided cross structure being configured to bend towards the normal direction until each protruding portion is in contact with each adjacent protruding portion to form a parabolic structure.

15. The intelligent robotic antenna according to claim 13, the substrate comprising a six-sided cross structure;

each protruding portion of the six-sided cross structure having trapezoid shape having two sides and two bases;

the conductive antenna element having a helical shape protruding in a normal direction from a plane of a center portion of the six-sided cross structure;

each side of each trapezoid shape being configured to bend towards the normal direction;

each outer base portion of the trapezoid shape being configured to bend towards a direction opposite of the normal direction; and each protruding portion of the six-sided cross structure being configured to bend towards the normal direction until each protruding portion is in contact with each adjacent protruding portion to form a parabolic structure.

16. The intelligent robotic antenna according to claim 13, the substrate comprising a six-sided cross structure;

each protruding portion of the six-sided cross structure having trapezoid shape having two sides and two bases;

the conductive antenna element having a helical shape protruding in a normal direction from a plane of a center portion of the six-sided cross structure;

each opposite side of the trapezoid shape being configured to bend towards the normal direction; each outer base portion of the trapezoid shape being configured to bend towards a direction opposite of the normal direction; and each protruding portion of the six-sided cross structure being configured to bend towards the normal direction until each protruding portion is in contact with each adjacent protruding portion to form a parabolic structure.

17. The intelligent robotic antenna according to claim 13, the substrate comprising a six-sided cross structure;

each protruding portion of the six-sided cross structure having trapezoid shape having two sides and two bases; the conductive antenna element having a helical shape protruding in a normal direction from a plane of a center portion of the six sided cross structure;

a pair of outer corner portions being configured to bend in direction opposite of the normal direction;

an outer base portion of the trapezoid shape being configured to bend towards a direction opposite of the normal direction; and each protruding portion of the six sided cross structure being configured to bend towards the normal direction until each protruding portion is in contact with each adjacent protruding portion to form a parabolic structure.

18. The intelligent robotic antenna according to claim 13, the environmental characteristics comprising at least one of wind pressure, exposure to temperature changes, exposure or absence of sunlight, and exposure to liquids or moisture.

19. The intelligent robotic antenna according to claim 13, the sensor being configured to sense characteristics of transmission and receiving signals of the antenna and the artificial intelligence code being configured to determine an optimal structural geometry of the antenna based upon the characteristics of desired transmission and the receiving signals of the antenna.

20. An intelligent robotic antenna, comprising:

four conductive antenna elements in a cross pattern, each having a triangular shape of equivalent dimensions to each other triangular shape and being connected at a respective tip of each triangular shape;

a sensor;

an actuator connected to the substrate; and a non-transitory computer readable medium comprising stored instructions that when executed cause at least one processor to:

sense, by the sensor, environmental characteristics surrounding the antenna;

execute artificial intelligence code to determine an optimal structural geometry of the antenna based upon the environmental characteristics surrounding the antenna; and transform, by the actuator, a structural geometry of the antenna to the optimal structural geometry of the antenna, the four conductive elements being configured to transform from a flat planar structure to a pyramidal structure by bending at each respective tip of each triangular shape until each triangular shape is connected to each adjacent triangular shape to form a pyramid.

* * * * *